US005826397A

United States Patent [19]

Armold

[11] Patent Number: 5,826,397

[45] Date of Patent: Oct. 27, 1998

[54] COLLAPSIBLE FRAMEWORK FOR TRADE SHOW DISPLAY

[76] Inventor: Charles K. Armold, 7410 Dormany Loop Rd., Plant City, Fla. 33565

[21] Appl. No.: 823,142

[22] Filed: Mar. 25, 1997

[51] Int. Cl.[6] ..... E04H 12/18

[52] U.S. Cl. ..... 52/646; 52/641

[58] Field of Search ..... 52/645, 646, 109, 52/641, 86

[56] References Cited

U.S. PATENT DOCUMENTS

| | | | |
|---|---|---|---|
| 3,381,923 | 12/1965 | Berry . | |
| 4,276,726 | 7/1981 | Derus | 52/646 X |
| 4,512,097 | 4/1985 | Zeigler . | |
| 4,658,560 | 4/1987 | Beaulieu . | |
| 4,663,899 | 5/1987 | Nodskov et al. . | |
| 4,809,471 | 3/1989 | Wichman et al. . | |
| 4,995,212 | 2/1991 | Morgan et al. . | |
| 5,016,418 | 5/1991 | Rhodes et al. | 52/646 |
| 5,115,623 | 5/1992 | Ahlberg . | |
| 5,123,550 | 6/1992 | Hodskou et al. | 52/109 X |
| 5,163,262 | 11/1992 | Adams | 52/646 |
| 5,203,126 | 4/1993 | Sorenson et al. | 52/109 |
| 5,203,134 | 4/1993 | Sorenson et al. | 52/646 |
| 5,230,196 | 7/1993 | Zeigler | 52/646 |
| 5,501,051 | 3/1996 | Harlan | 52/646 |

OTHER PUBLICATIONS

Product Brochure, titled Travelite Pop–up Display by Expo-Systems; 1991.

Product Brochure, titled Travelite 2001 Premier Pop–up Display by ExpoSystems.

*Primary Examiner*—Christopher Kent

*Attorney, Agent, or Firm*—Stein, Schifino & Van Der Wall

[57] ABSTRACT

A collapsible display system for securing cladding panels, containing information material, capable of being configured into multiple configurations and, therefore, adaptable to the space allocated to a vendor. The present invention comprises a plurality of hub members connected with a plurality of support members. The hub members are spaced apart from one another defining a plurality of adjacent box-like units wherein adjacent units share common hub members. Diagonal support members are pivotly coupled to the hub members between the front and back of the display system in a scissors-like manner. Horizontal support members having a pivot point at their midpoint are pivotly connected between pairs of adjacent hub members. The lengths of the horizontal support members are greater than the distance between each pair of hub members. Adjustable stabilizing members with a telescoping brace are disposed between adjacent hub members and are detachably coupled between diagonal support members pivotly connected to those hub members. Shaping members are detachably coupled to the diagonal support members in order to maintain the desired configuration. Also, vertical support members are detachably coupled to the display system, between the hub members, to maintain the display system in the erect position.

17 Claims, 10 Drawing Sheets

12
14
15
16
18
20
22
23
26
28
30
32
34
42

COLLAPSIBLE FRAMEWORK FOR TRADE SHOW DISPLAY

BACKGROUND OF THE INVENTION

1. Field of the Invention

The present invention relates to collapsible self-supporting trade show or convention backdrops. This invention more particularly pertains to a structure for securing cladding panels, containing publicity or information material regarding a vendors product, while the display system is in a temporarily expanded position.

2. Description of the Background Art

In the field of trade show conventions, spaces are typically allocated with minimal frontages. Most commercially available backdrops or display devices are produced with either eight or ten foot increments. Moreover, these backdrops typically have limited configurations to which the vendor may adapt his display. Simply, most commercially available backdrops are limited to one particular shape and size. Therefore, the vendor often must purchase multiple backdrops of varying shapes and sizes such that he may be properly suited for various convention or trade show locations.

Many portable display systems are known. For example, U.S. Pat. No. 5,115,623 to Ahlberg discloses a display system constructed of bars or tubes and connecting pieces wherein the bars or tubes are pivoted to each other in pairs at their midpoints and form crossing diagonal struts. The Ahlberg system is braced vertically by dismountable struts which are attached to the outside of the display between adjacent connecting pieces which are also for receiving the bars or tubes. However, the patent to Ahlberg neither discloses a display system having adjustable stabilizing or shaping members nor does it solve the problem of limiting the vendor to one particular configuration.

U.S. Pat. No. 4,809,471 to Wichman, et al., teaches a folding display frame comprising a grid of horizontal and vertical rod members forming an array of three dimensional cubicles. The ends of the rods in each cubicle are pivotally attached to corresponding hubs located at each of the corners of the cubicle. Separate diagonal stabilizing members having telescopic braces are located within the bottom cubicles which prevent the cubicles from being distorted while in its expanded configuration. However, this reference does not disclose a stabilizing member other than in a diagonal position in the bottom cubicles and does not disclose a collapsible display system or backdrop configured like the present invention.

U.S. Pat. No. 4,663,899 to Nodskov, et al., discloses an exhibition panel composed of square units of pivotally connected rods. The units have vertical unit surfaces for the arrangement of posters and horizontal and vertical side faces defined by two rods pivotally connected in a scissors-like manner wherein the ends of the rods are pivotally connected with corner joints located at the unit surfaces. A central joint is connected with four corner joints at one unit face through diagonally extending rods which are pivotally connected with diagonal rods to the corner joints at the opposite unit face. A releasable locking device is provided width-wise between one pair of opposed corner joints and between the unit surfaces. The patent to Nodskov, et al., does not disclose an adjustable stabilizing member horizontally disposed between the hub members positioned within the front or back surfaces, that is length-wise, of the display system. Moreover, the patent to Nodskov, et al., does not teach a horizontal support member having a pivot means at the midpoint of the horizontal support members for forming a unit in the display system. The patent to Nodskov, et al., therefore, discloses a display system distinguishable from the present invention.

Also, U.S. Pat. No. 4,658,560 to Beaulieu teaches a support and attachment brace for a collapsible display panel structure having hub assemblies with outwardly fastening buttons thereon. The hub assemblies include an elongated rigid bar or brace with top and bottom ends where each are adapted for releasably interconnection with one of a pair of confronting vertically aligned fastening buttons. A magnetic strip along the length of the brace provides a means for releasably attaching a display to the structure. The patent to Beaulieu, however, does not disclose a plurality of adjustable stabilizing members, comprising a telescoping means, horizontally disposed between hub members as does the present invention. Moreover, the patent to Beaulieu does not disclose a plurality of horizontal support members having a pivot means at their midpoint.

U.S. Pat. No. 4,512,097 to Zeigler discloses a mounting clip for a display stand comprising a plurality of sections formed by a plurality of pairs of crossed rods with the rods being joined at a number of corners and centrally of the corners of each section by associated hubs. Also, U.S. Pat. No. 3,381,923 to Berry discloses a deployable structure having a plurality of central members formed with telescoping pieces which are connected together by scissors links. The structure the patent to Berry discloses can be used to deploy a folded piece of material into a predetermined configuration. However, these latter two patents neither disclose a collapsible display apparatus configured like the present invention nor do they solve the problems of unnecessarily limiting the vendor to particular configurations.

U.S. Pat. No. 4,995,212 to Morgan, et al., discloses a collapsible framework comprising a plurality of spars pivotally connected with hub members and one another to form a linkage. An upright brace is detachably connected between at least one hub member and an adjoining hub member above it. A first set of hub members is disposed in the front of the framework and a second set is disposed in the rear of the framework. Opposite hub members of the first and second sets are connected by tension springs which assist in the unfolding and erection of the framework and provide the forces necessary to hold the framework in its erect position. Vertical braces are detachably connectable between the hub members once the framework has been erected. The patent to Morgan does not teach a plurality of adjustable stabilizing members having a telescopic means horizontally disposed between hub members. Moreover, a plurality of horizontal support members having a pivot means is not disclosed. Therefore, the patent to Morgan discloses a display system distinguishable from the present invention.

In as much as the art consists of various types of collapsible backdrops, it can be appreciated that there is a continuing need for and interest in improvements to these display systems, and in this respect, the present invention addresses these needs and interests.

Therefore, the principal object of this invention is to provide an improvement which overcomes the aforementioned inadequacies of the prior art devices and provides an improvement which is a significant contribution to the advancement of the backdrop art.

Another object of this invention is to provide a new and improved display system which has all the advantages and none of the disadvantages of the earlier display systems.

Still another objective of the present invention is to provide a display system having numerous alternative configurations such that the vendor has a single versatile display system compatible with all types of vendor spaces.

Yet another objective of the present invention is to provide a display system that is lightweight and easily transportable to other locations.

Still a further objective of the present invention is to provide a display system that is easily manufactured and assembled.

Yet a further objective is to provide a display system that is easily erected.

An additional objective is to provide a collapsible display system having a front and a back, the display system comprising, in combination a plurality of adjacent box-like units with each having eight corners, the units defined by a plurality of hub members, the corners of the units having one of the plurality of hub members, and each of the plurality of adjacent units sharing common hub members; a plurality of diagonal support members slanting from the hub members on the front of the display system to opposite hub members on the back of the display system, the diagonal support members pivotly coupled to the hub members respectively, and each of the plurality of diagonal support members crossing over another of the plurality of diagonal support members in a scissors-like manner; a plurality of horizontal support members with each having a pivot means at its midpoint for providing a flexible pivot point, each one of the plurality horizontal support members disposed between two adjacent hub members of said plurality of hub members respectively and pivotly coupled thereto, each of the plurality of horizontal support members having a length greater than a distance between each of the hub members being connected thereto; a plurality of shaping members horizontally disposed upon the display system, the shaping members detachably coupled to at least two of the plurality of hub members whereby the plurality of shaping members help to form the display system; a plurality of vertical support members vertically disposed upon the display system, the plurality of vertical support members detachably coupled to at least two of the plurality of hub members whereby the plurality of vertical support members help to form the display system; and a plurality of adjustable stabilizing members, each of the plurality of stabilizing members comprising a telescoping means for adjusting the length of each of the plurality of adjustable stabilizing members, each of the plurality of adjustable stabilizing members being mounted within the display system such that the plurality of adjustable stabilizing members expand the display system as well as prevent the display system from distorting, each one of the plurality of stabilizing members being substantially horizontally disposed between two adjacent hub members of the plurality of hub members and detachably coupled to the diagonal support members being pivotly coupled to the hub members respectively.

Another objective is to provide a collapsible display system comprising, in combination, a plurality of support members coupled with a plurality of hub members, at least one of the plurality of support members being a vertical support member detachably connectable between at least one of the plurality of hub members and an adjoining hub member of the plurality of hub members above it wherein the plurality of hub members include a first plurality of hub members positioned in the front of the display system and a second plurality of hub members positioned in the back of the display system, the first and second plurality of hub members spaced from one another while the display system is in an erect position and pivotly connected with one another via another of the support members being diagonal support members, another of the support members being adjustable stabilizing members horizontally disposed between two adjacent hub members of the second plurality of hub members in the back of the display system and detachably coupled to the diagonal support members being pivotly coupled the hub members respectively, the adjustable stabilizing members comprising a telescoping means for adjusting the length of the adjustable stabilizing member, and another of the support members being a horizontal support member having a pivot means at its midpoint for providing a flexible pivot point, each of the horizontal support members having a length greater than a distance between two adjacent hub members of the first plurality of hub members in the front of the display system.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies this need for an improved single display system which is adaptable to multiple configurations. For the purpose of summarizing the invention, the invention comprises a plurality of support members connected with a plurality of hub members. One of the members is a vertical support member which is detachably connected between at least one of the hub members and an adjoining hub member above it. While in the erect position the hub members are spaced from one another. The hub members define a plurality of adjacent box-like units with each having eight corners. A hub member is in each corner of a unit with adjacent units sharing common hub members.

Another of the support members are diagonal support members slanting from the front to the back of the display system and vice versa. The diagonal support members are pivotly coupled to the hub members and cross over each other in a scissors-like manner.

Also, horizontal support members having pivot means at their midpoints are disposed, and pivotly connected thereto, between pairs of adjacent hub members. The lengths of each of the horizontal support members is greater than the distance between each respective pair of hub members.

Shaping members are horizontally disposed upon the system in order to conform the display system to the desired configuration. The shaping members may be straight, convex or concave and are detachably coupled to the display system once the vendor has the display system in the desired configuration within the space provide for his presentations. The shaping members are detachably coupled to at least two of the hub members on either side of the backdrop.

An important feature of the present invention is the adjustable stabilizing members. The adjustable stabilizing members comprise a telescoping means which, in turn, comprises a telescoping brace comprised of inner and outer rod members which are slidable relative to each other. The rod members have a restricting means comprising a spring-biased pin and a locking hole for restricting the adjustable stabilizing members to a particular position. Therefore, it can be readily seen that the present invention provides a means to collapse and expand a display system capable of being configured to suit the vendor's diverse needs. Thus, a display system of the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which:

Fig. 10C is a cross-sectional view of the curved shaping member as shown in Figs. 10A and 10B.

Fig. 11C is a cross-sectional view of the straight shaping member as shown in Figs. 11A and 11B.

Similar reference characters refer to similar parts throughout the several views of the drawings.

DETAILED DESCRIPTION OF THE PREFERRED EMBODIMENT

Figure 1:
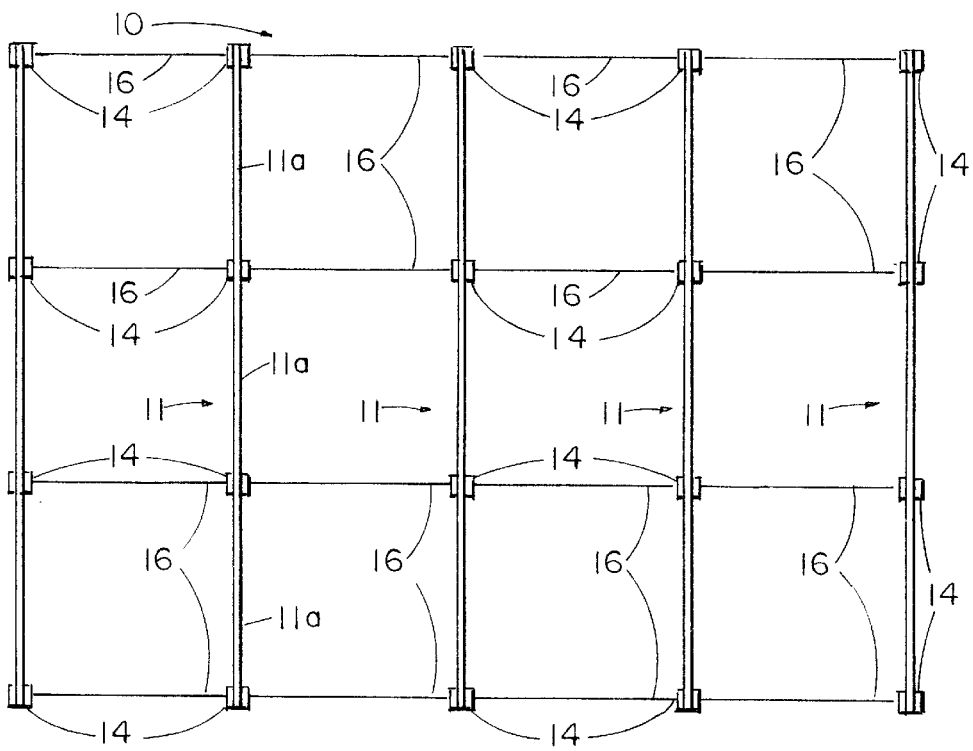
FIG. 1 is a front elevation of an erect display system embodying the present invention in the flat-faced mode.
Figure 2:
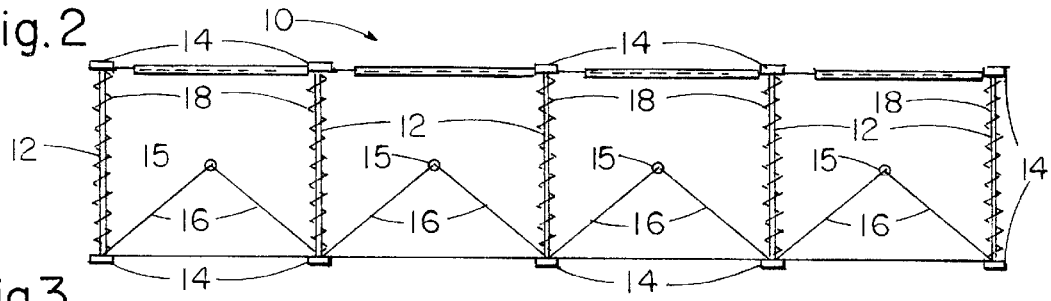
FIG. 2 is a top planar view of the erect display system of the present invention.
Figure 3:
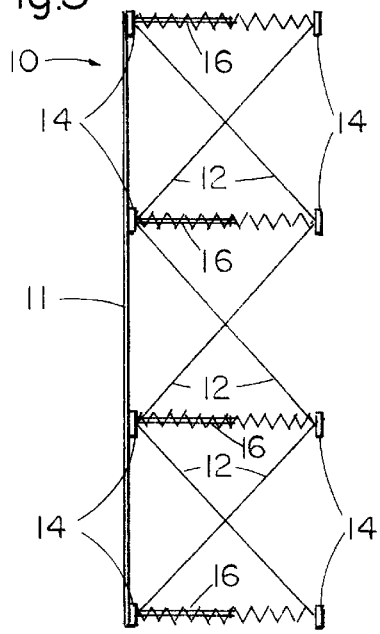
FIG. 3 is a is a side elevation view of the erect display system in the flat-faced mode.

With reference to the drawings, and in particular to FIG. 1 thereof, a new and improved display system for hanging and securing cladding panels, containing publicity or information material, embodying the principles and concepts of the present invention and generally designated by the reference number 10 will be described. As shown in FIG. 1, the present invention comprises a plurality of adjacent box-like units 6 with each unit 6 having eight corners 8. FIGS. 2 and 3 further illustrate the box-like units 6. Each of the units 6 are defined by a plurality of hub members 14 wherein the corners 8 of each unit 6 have one of the plurality of hub members 14. The plurality of hub members 14 could be described as including a first plurality of hub members 14 positioned in the front of the display system 10 and a second plurality of hub members 14 positioned in the back of the display system 10 wherein the first and second plurality of hub members are spaced from one another while the display system 10 is in an erect position. Each of the adjacent units 6 share common hub members 14 as shown in FIGS. 1, 2 and 3.

Figure 4:
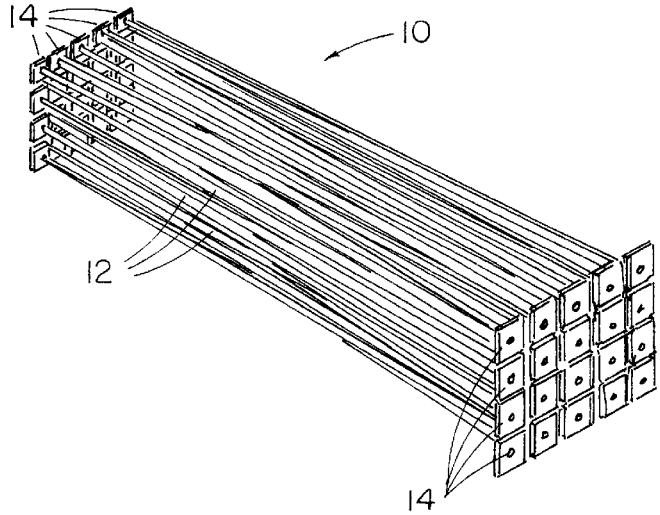
FIG. 4 is a perspective view illustrating the display system of the present invention in the collapsed position.

The hub members 14 are as illustrated in FIG. 4 of U.S. Pat. No. 4,995,212 to Morgan, et al. Similarly, hub members 14 are illustrated here in FIGS. 5A and 5C. As shown here in FIGS. 5A and 5C, each hub member 14 has the general shape of a square plate having a central boss 20 on one side from which four pairs of integral lugs 22 extending from the central boss 20 to respective edges of the hub member 14. The lugs 22 of each pair lie in respective planes perpendicular to the major plane of the plate and perpendicular to the respective edge of the plate to which they extend. Each of the pair of integral lugs 22 are configured for allowing pivot coupling thereto. Between the lugs 22 of each pair is an eye part of a respective connection member 23 which is pivotally connected with the lugs 22, for pivoting in a plane parallel with the planes of the lugs 22, by a respective pivot pin passed perpendicularly through aligned holes in the lugs 22 of the pair and the hole in the eye part of the connection member 23. Each connection member 23 further includes a serrated peg which is received as a tight fit within a respective end of support members 12 and 16.

Thus, each support member 12 and 16 is pivotable with respect to the hub member 14 about a respective one of four axis, each parallel with and adjacent to a respective edge of the hub member 14. The planes of each pair of lugs 22 are off-set to one side of the respective parallel plane passing through the center of the plate. This allows for the offset which exists between the diagonal support members 12 and the offset which exist between the horizontal support members 16. This offset occurs because of the finite diameters of the diagonal support members 12 and horizontal support members 16 and the fact that each of the support members 12 and 16 overlap at their middles where they are preferably connected.

A central bore extends through each hub member 14, perpendicular to the major plane of the hub member 14 and through the central boss 20 thereof. This bore receives a cylindrical peg 26 which projects from the face of the hub member 14 opposite the boss 20. This bore also receives a looped end of a helical tension spring 18, or tensioning element, which is retained by a metal pin 28 passed through the boss 20 to intersect the central bore diametrically. The spring 18 is thus retained against being pulled out from the central boss 20. The spring 18, or tensioning element, is coupled between opposing hub members 14 on the front and the back of the display system 10 respectively. This spring 18 is what enables the vendor to erect the display system 10 with assistance from the tensioning of the springs 18 and, thereby, causing the framework to "pop up" into the erect configuration. The springs 18 are relied upon to hold the structure in its erected state only temporarily however. To fix the structure securely in its erected state, a plurality of vertical support members 11 are subsequently fitted.

Figure 22:
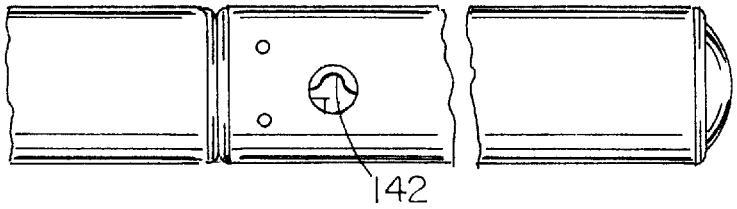
FIGS. 22, 23 and 24 are respectively fragmentary front elevation, side elevation and rear views of the vertical support member.
Figure 23:
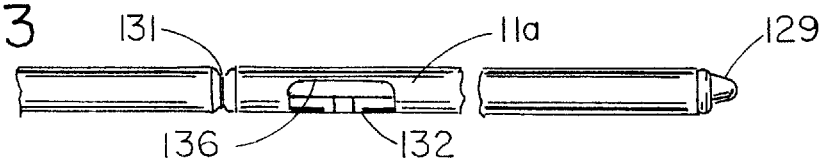
Figure 24:
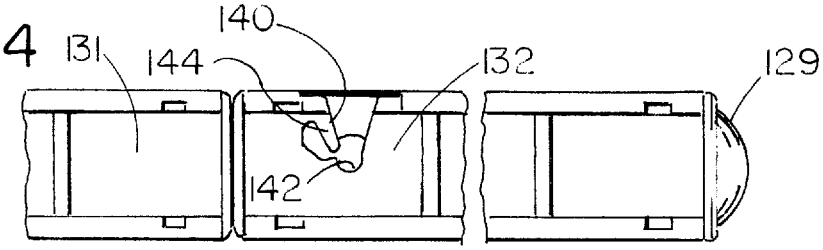
Figure 25:
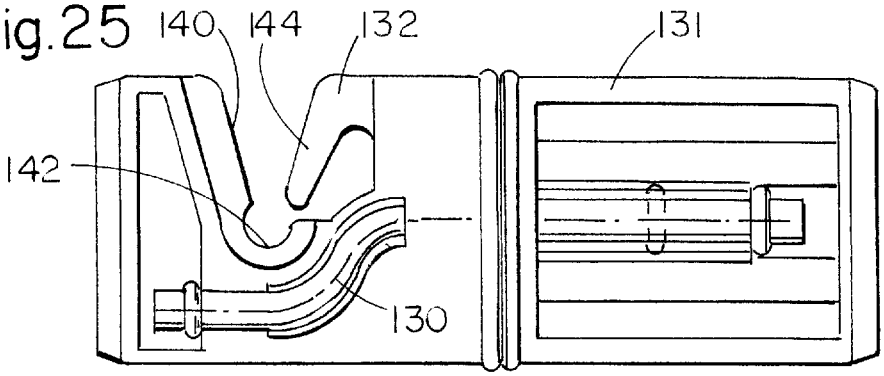
FIGS. 25 and 26 are elevational and sectional views respectively of cooperating connector elements for lengths of the vertical support member.
Figure 26:
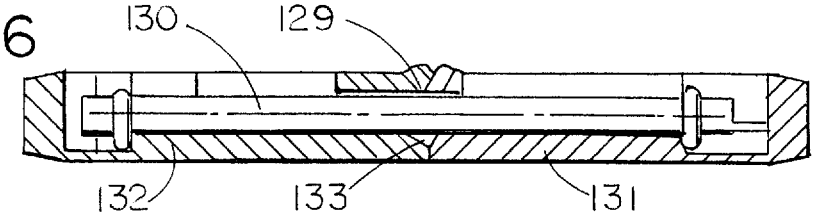
Figure 27:
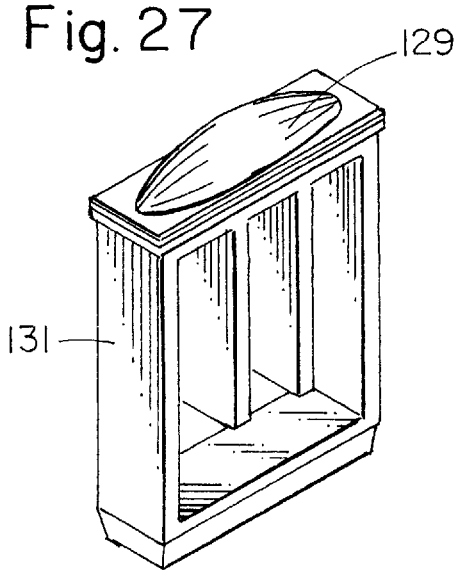
FIG. 27 is a perspective view of the male connector element of the elements of FIGS. 25 and 26.
Figure 28:
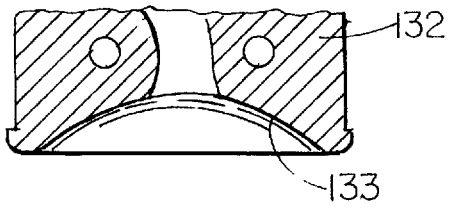
FIG. 28 is a fragmentary sectional view of the female connector element of the elements of FIGS. 25 and 26.

The vertical support members 11 are vertically disposed upon the display system 10 and extend over its whole height. The vertical support members 11 are detachably coupled to at least two of the plurality of hub members 14 whereby the plurality of vertical support members 11 help to form the display system 10. In other words, the vertical support member 11 is detachably connectable between at least one of the plurality of hub members 14 and an adjoining hub member 14 above it. The vertical support members 11, and their connection to the hub members 14, are as those disclosed in U.S. Pat. No. 4,995,212 to Morgan, et al, or otherwise commonly know in the industry. However, a description of the vertical support members 11 and their connection to the display system 10 is as also described hereinafter. Each vertical support member 11 comprises a plurality of lengths 11*a*, fitted end to end, of a rolled steel channel section extrusion, each length 11*a* extending between one of the hub members 14 and the hub member 14 directly above or directly below and preferably at the front of the erected frame. As shown in FIGS. 22 to 24, each said length 11*a* of a vertical support member 11 has at its upper end, an upwardly projecting tapering tongue 129, and has its lower end, a downwardly open socket 133 as shown in FIG. 28, to receive the tongue 129 at the upper end of the adjoining length 11*a*. The tongues 129 and sockets 133 are afforded by molded plastic members 131 and 132 respectively secured within the respective ends of the channel-section lengths 11*a*. The members 131 and 132 are best shown in FIGS. 25 to 27. Adjoining lengths 11*a* of a vertical support member 11 are interconnected by respective lengths 130 of elastic cord, each length 130 of cord extending through longitudinal bores in the respective members 131 and 132 and having its respective ends retained within the members 131 and 132. The arrangement is such each elastic cord is still under some tension when the tongue of member 131 is fully engaged in the socket of member 132, yet can be stretched further to allow disconnection of the members 131 and 132 so that each vertical support member 11 can be folded up in a zig-zag fashion about the joints between respective lengths 11*a*.

As shown in FIGS. 23 and 24, each length 11*a* of a vertical support member 11, adjacent to its lower end, has its channel wall and flange cut away, on one side, as indicated at 136, in the region of the respective member 132 and the insert 132, on the same side, is provided with a slot 140 extending transversely into the member 132 from said one side, the slot 140 tapering in width from said one side to a central blind end of the slot, where the member 132 provides a part-cylindrical recess 142 adapted to fit snugly with the exterior surface of a peg 26. The bottom edge of the slot 140 is provided by a portion of the insert 132 which is in the form of an integral resilient finger 144, connected with the remainder of the member 132 at a position adjacent the cutaway side of the vertical support member length 11*a*, and terminating, at its free end, adjacent the recess 142. In assembly of the display system 10, with the display system 10 expanded and the vertical support lengths 11*a* already flexibly attached at its upper end to the length 11*a* above, or to a fitment at the top of the display, is swung laterally into cooperation with the projecting peg 26 of the hub member 14 to which it is attached, so that the peg 26 enters the opening 136 and passes along the slot 140 to engage in the blind end 142. The narrowest end of the slot 140 is somewhat narrower than the diameter of the peg 26 so that the arm 144 is displaced resiliently to allow the peg 26 to pass and springs back when the peg 26 is fully engaged with the concave surface at the blind end 142 whereby the arm 144 holds the peg 26 in place. The thickness of the portions of the member 132 which defines the slot 140, as measured in a direction from the front to the rear of the assembled frame, corresponds substantially with that of a peripheral annular groove around the peg 26. The portions of member 132 defining the slot 140 are thin plate-like parts set rearwardly relative to the base of the length 11*a* to define a cavity behind the base of the length 11*a* and in front of these plate-like parts to receive the end portion of the peg 26 extending forwards of the peripheral groove, when these plate portions are engaged in the peripheral groove around the peg 26.

Preferably, the vertical support members 11 are vertically disposed between the plurality of hub members 14 upon the front of the display system 10 as shown in FIGS. 1 and 3. The vertical support members 11 are manufactured of iron or steel whereby a cladding panel 40 (described in the prior art) having a magnetic securing means thereon can readily be attached to the display system.

The present invention further comprises a plurality of diagonal support members 12 slanting from the hub members 14 on the front of the display system 10 to opposite hub members 14 on the back of the display system 10. The diagonal support members 12 are pivotly coupled to respective hub members 14 and each of the diagonal support members 12 cross over another one of the plurality of diagonal support members 12 in a scissors-like manner. In other words, the first and second plurality of hub members 14 are pivotly connected with one another via support members being the diagonal support members 12. It is preferable that the support members 12 are pivotly connected where they cross.

Figures 5A, 5B, 5C:
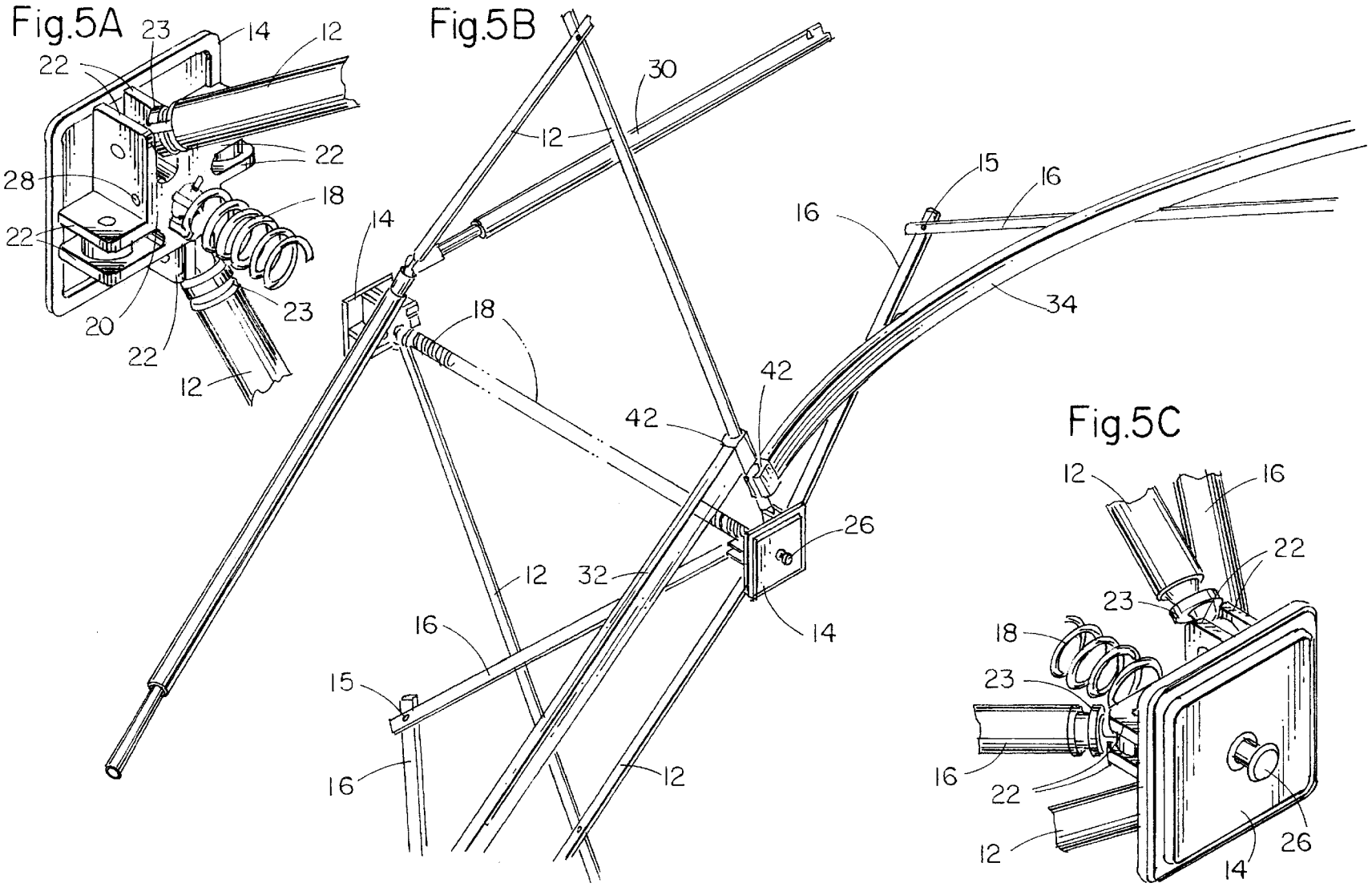
FIG. 5A is a rear perspective view as viewed from the front of the display system of a typical hub member with diagonal support members connected thereto.
FIG. 5B is a front perspective view of a straight shaping member in conjunction with a concave shaping member.
FIG. 5C is a front perspective view of a hub member with both diagonal support members and horizontal support members connected thereto.

The present invention further comprises a plurality of horizontal support members 16 with each having a pivot means 15 at its midpoint for providing a flexible pivot point 15 as shown in FIG. 5B. Each of the horizontal support members 16 are disposed between two adjacent hub members 14 respectively and pivotly coupled thereto as shown in FIGS. 2 and 5B. The support members 16 should be detachably coupled to at least two of the diagonal support members 12. The length of the horizontal support member 16 should be greater than the distance between each respective pair of hub members 14 as shown in FIG. 2. Preferably, the horizontal support members 16 should be disposed between the plurality of hub members 14 upon the front of the display system 10.

In order to configure the display system 10 of the present invention, the vendor couples shaping members 32, 34 and/or 36 to the display system 10. The shaping members 32, 34 and 36 are horizontally disposed upon the display system 10 and are detachably coupled to at least two of the diagonal support members 12 thereby helping to form the display system within the confines of the vendor's allocated space. Preferably, the shaping members 32, 34 and 36 are horizontally disposed between the plurality of hub members 14 upon the front of the display system 10. The shaping members 32, 34 and 36 are clipped on to the diagonal support members 12, as shown in FIG. 5B, with end clips 42 as described below. It is the particular shape and length of the shaping members 32, 34 and 36 which determines the shape of the front of the backdrop. In theory, this would be the only requirement to achieve a given display shape. In practice, however, the inventor deems it necessary to further stabilize the display system with adjustable stabilizing members 30 as described below.

Figure 6:
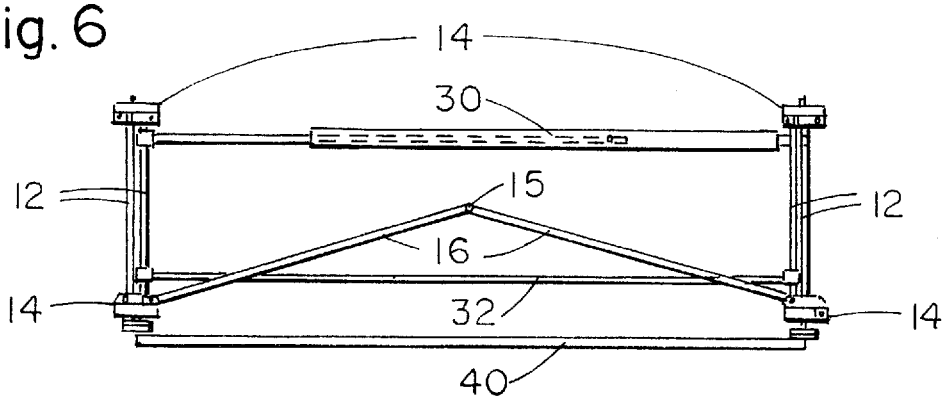
FIG. 6 is a top planar view of a straight shaping member.
Figure 7:
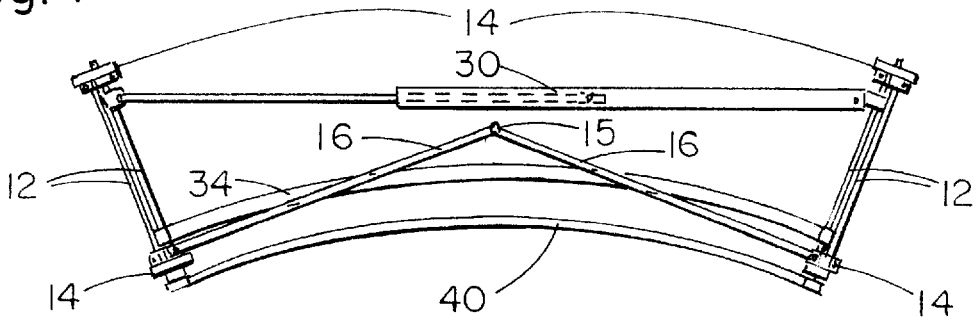
FIG. 7 is a top planar view of a concave shaping member.
Figure 8:
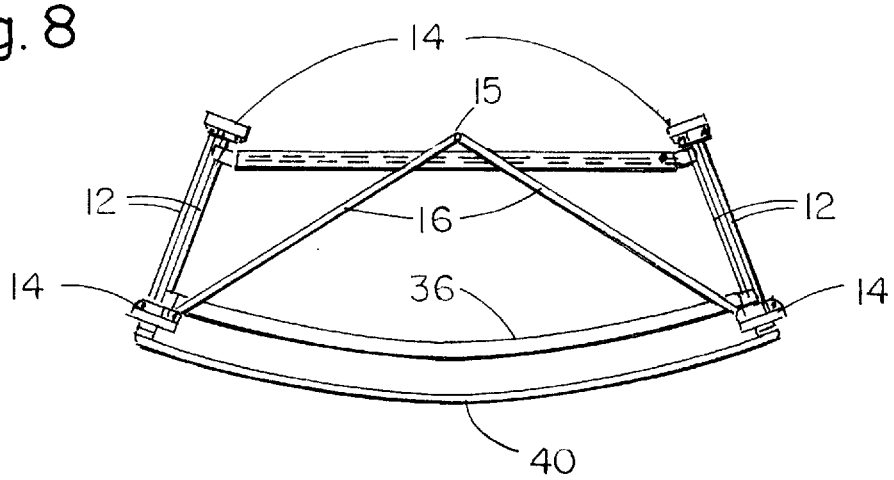
FIG. 8 is a top planar view of a convex shaping member.

FIG. 6 is a particular illustration of the straight shaping member 32. The concave shaping member 34 is illustrated in FIG. 7 and the convex shaping member 36 is illustrated in FIG. 8. FIGS. 12 through 21 illustrate the numerous variations of available configurations for the present invention utilizing multiple shaping members and combinations thereof. These configurations are distinguishable from one another in that they use different combinations of shaping members 32, 34 and/or 36. Moreover, different lengths may be utilized by the vendor to construct a particular configuration suiting his particular needs.

The present invention further comprises a plurality of adjustable stabilizing members 30. The adjustable stabilizing members 30 comprise a telescoping means 31, 33 for adjusting the length of each of the adjustable stabilizing members 30. As shown in FIG. 5B, each one of the adjustable stabilizing members are substantially horizontally disposed between two adjacent hub members 14 on the rear of the display system 10 and are detachably coupled to the diagonal support members 12 which are pivotly coupled to those hub members 14 respectively. The adjustable stabilizing members 30 are clipped onto the rear ends of the diagonal support members 12 either above or below the hub member 14. The plurality of adjustable stabilizing members 30 expand the display system 10 as well as prevent the display system 10 from distorting. Preferably, the adjustable stabilizing members 30 are disposed between the plurality of hub members 14 on the back of the display system. In other words, the adjustable stabilizing members 30 are horizontally disposed between two adjacent hub members of the second plurality of hub members in the back of the display system.

The telescoping means 31, 33 comprises a telescoping brace 31, 33. The telescoping brace 31, 32 comprises of an inner rod member 31 and outer rod member 33. The rod members 31 and 33 are slidable relative to each other to adjust the length of the telescoping brace 31, 33. It is necessary to adjust the length of the stabilizing member 30 because of the various shapes the front of the display system 10 may be configured into. Therefore, a single display system, such as the present invention, may be configured into multiple positions with a single adjustable stabilizing member 30.

The rod members 31 and 33 of the adjustable stabilizing members 30 have a restricting means 35, 37 for restricting the maximum length of the telescoping brace 31, 33. The restricting means 35, 37 comprises a spring-biased pin 35 on the inner rod member 31 and a locking hole 37 for engaging the spring-biased pin 35 on the outer member 33.

Figure 9A:
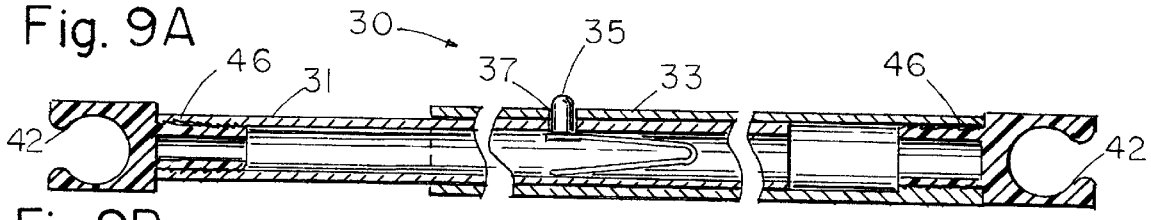
FIG. 9A is a cross-sectional view of a telescoping stabilizing member.
Figure 9B:
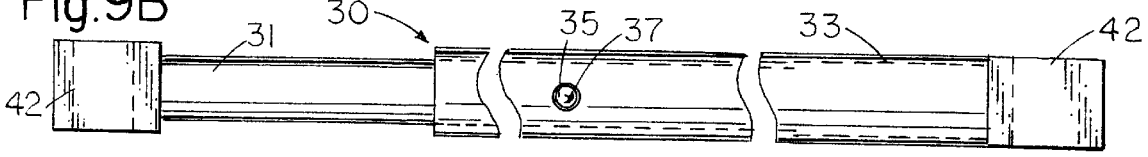
FIG. 9B is an elevational view of the telescoping stabilizing member shown in FIG. 9A being rotated 90 degrees.
Figure 10A:
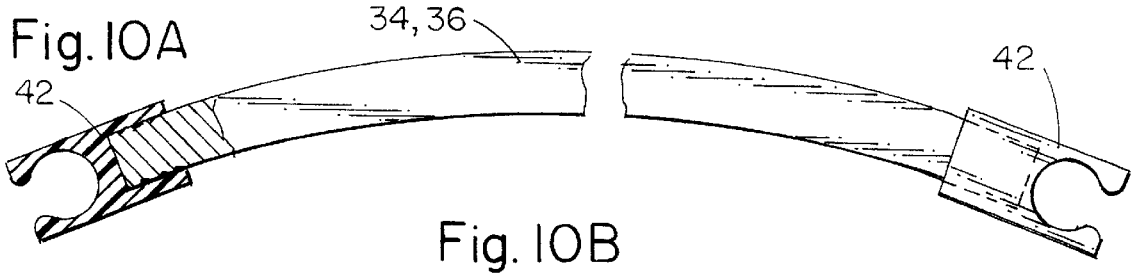
Fig. 10A is a partial top planar view of a curved (concave or convex) shaping member.
Figure 10B:
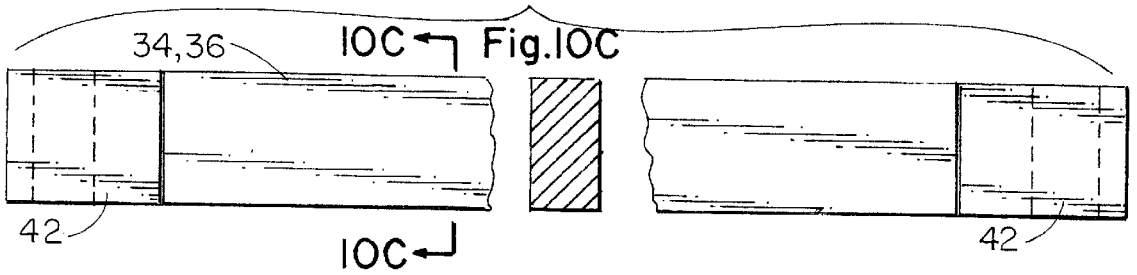
Fig. 10B is a side elevational view of the curved shaping member as shown in FIG. 10A.
Figure 11A:
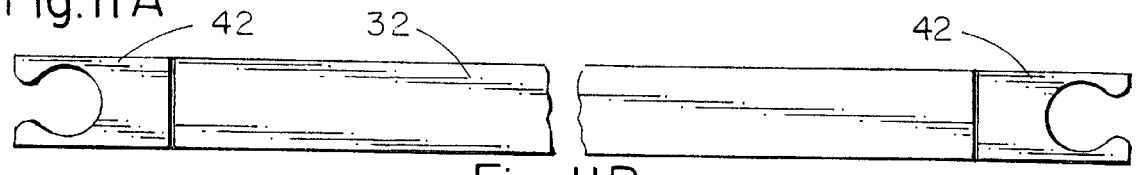
FIG. 11A is a top planar view of a straight shaping member.
Figure 11B:
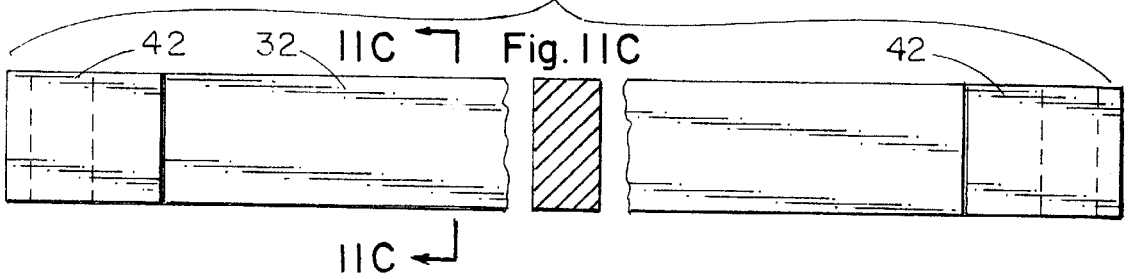
FIG. 11B is a side elevational view of the straight shaping member shown in FIG. 11A.
Figure 12:
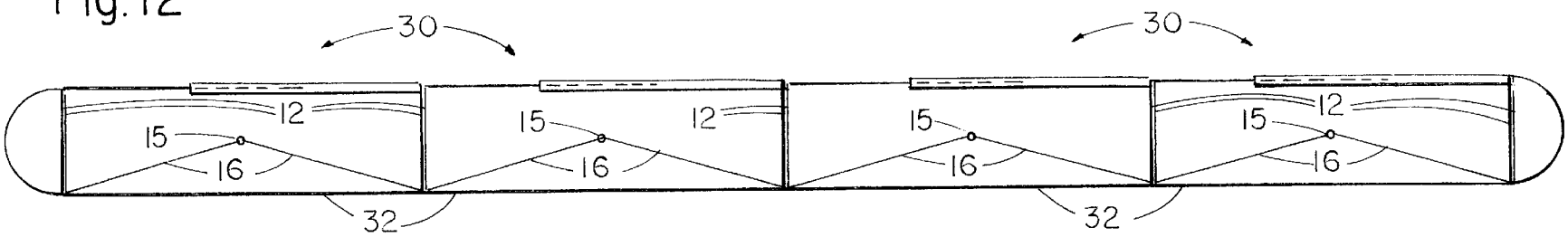
FIG. 12 is a top planar view of the display system of the present invention having straight shaping members.
Figure 13:
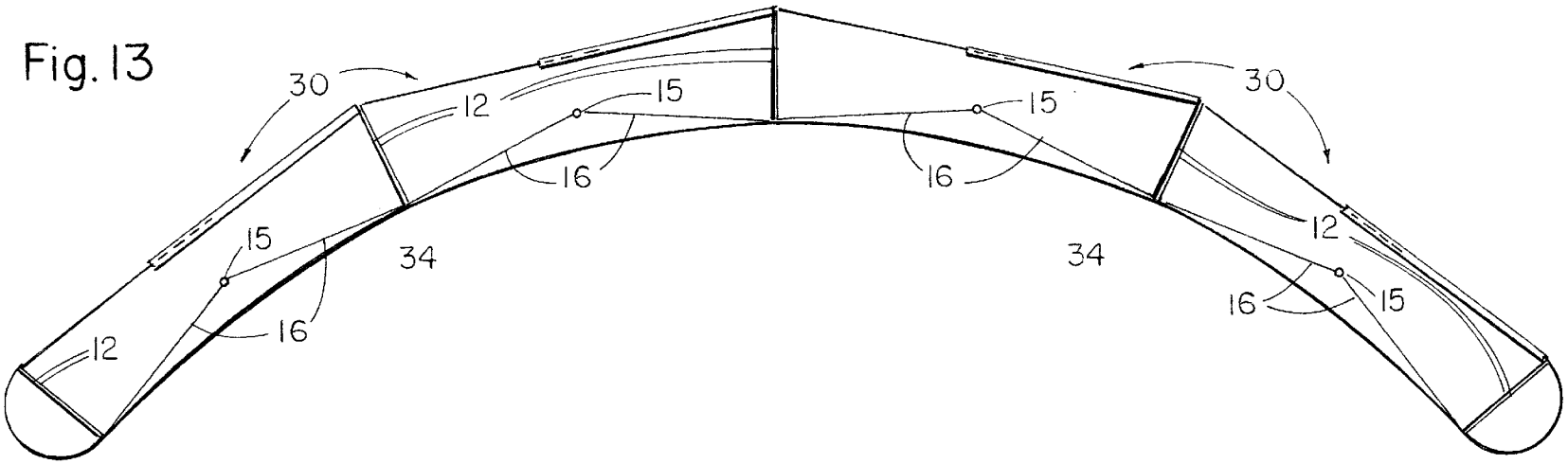
FIG. 13 is a top planar view of the display system of the present invention having concave shaping members.
Figure 14:
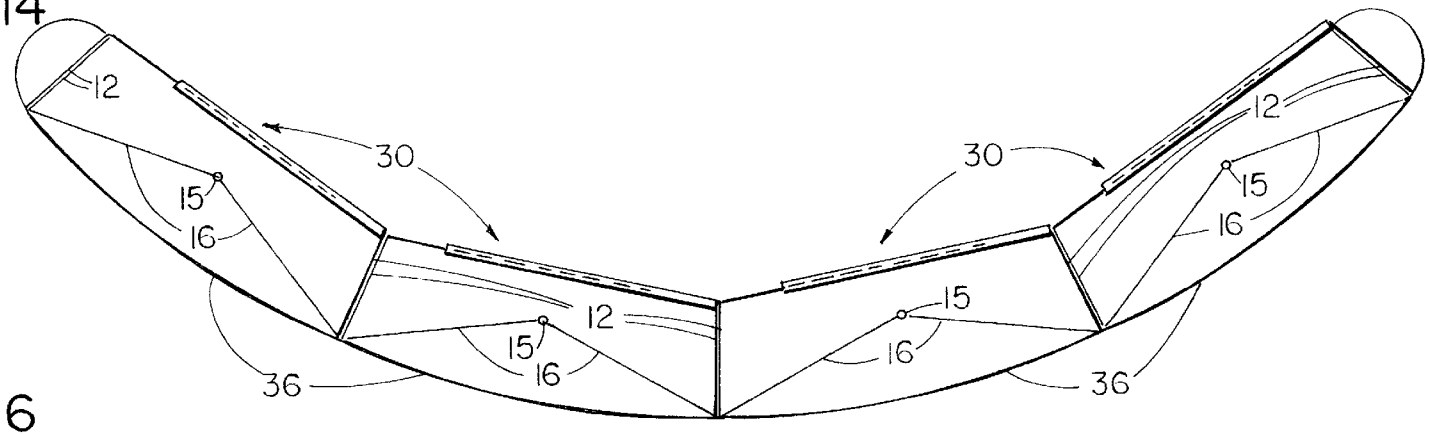
FIG. 14 is a top planar view of the display system of the present invention having convex shaping members.
Figure 16:
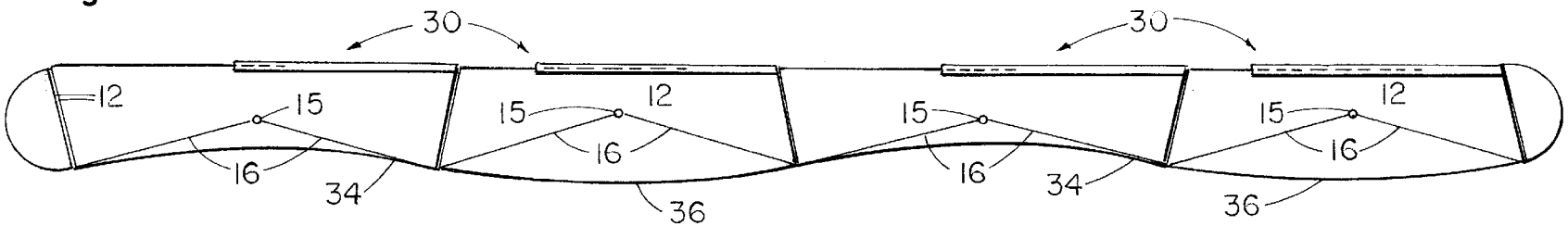
FIG. 16 is a top planar view of the display system of the present invention having alternating convex and concave shaping members.
Figure 15:
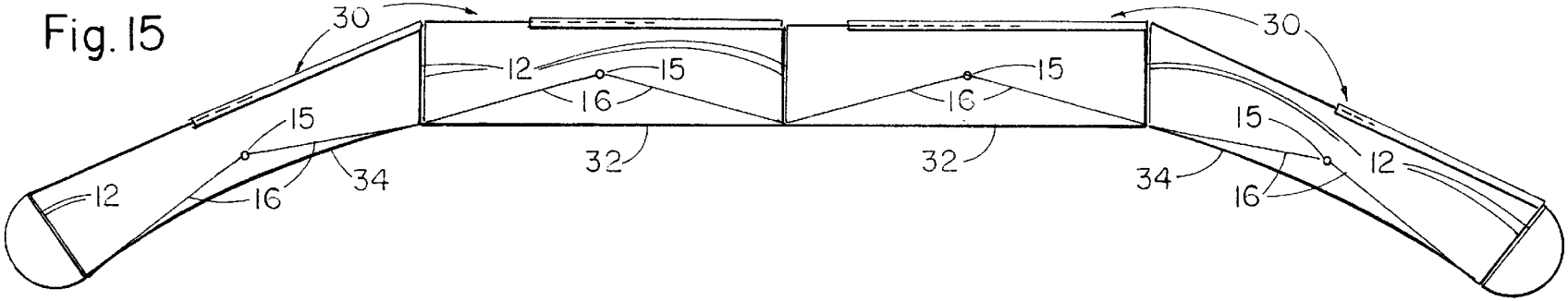
FIG. 15 is a top planar view of the display system of the present invention in an alternative configuration having both straight and concave shaping members.
Figure 17:
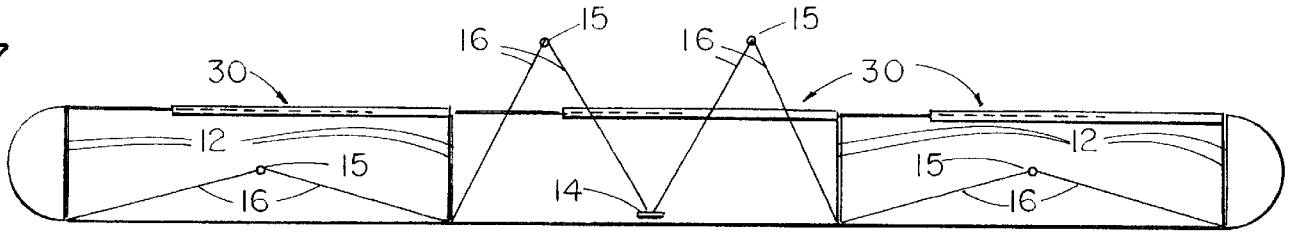
FIG. 17 is a top planar view of the display system of the present invention in an alternative configuration having straight shaping members.
Figure 18:
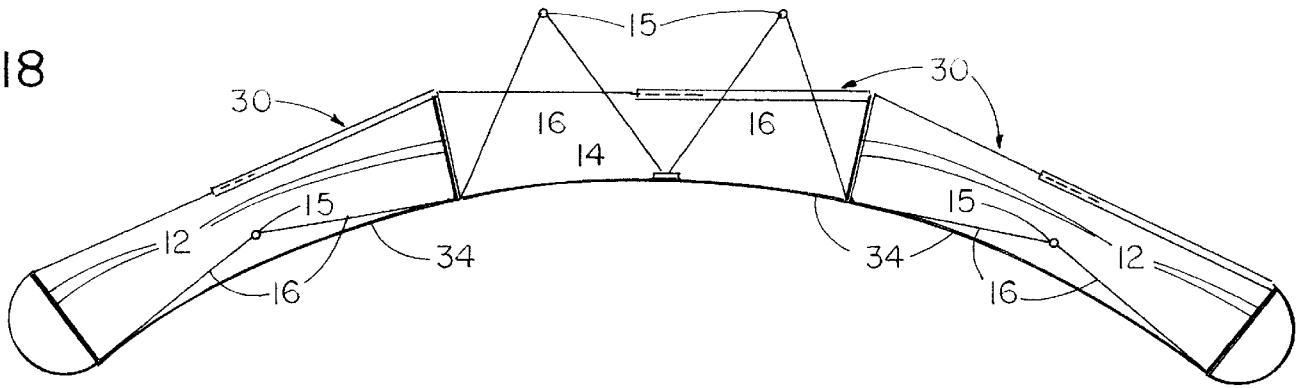
FIG. 18 is a top planar view of the display system of the present invention in an alternative configuration having concave shaping members.
Figure 19:
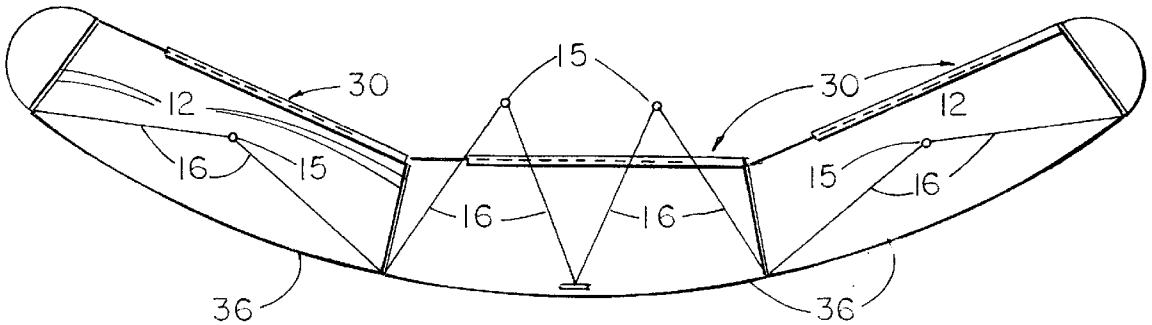
FIG. 19 is a top planar view of the display system of the present invention in an alternative configuration having convex shaping members.
Figure 21:
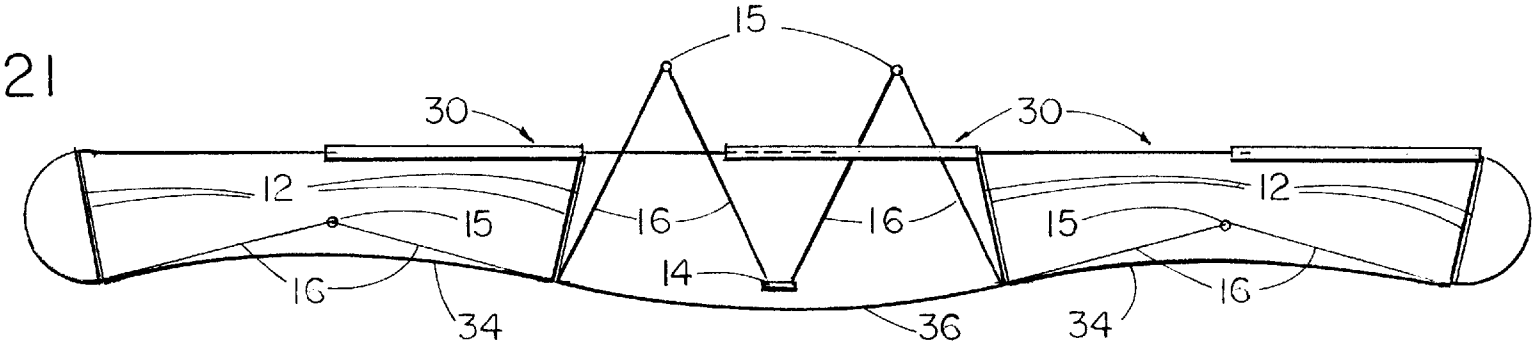
FIG. 21 is a top planar view of the display system of the present invention in an alternative configuration having alternating concave and convex shaping members.
Figure 20:
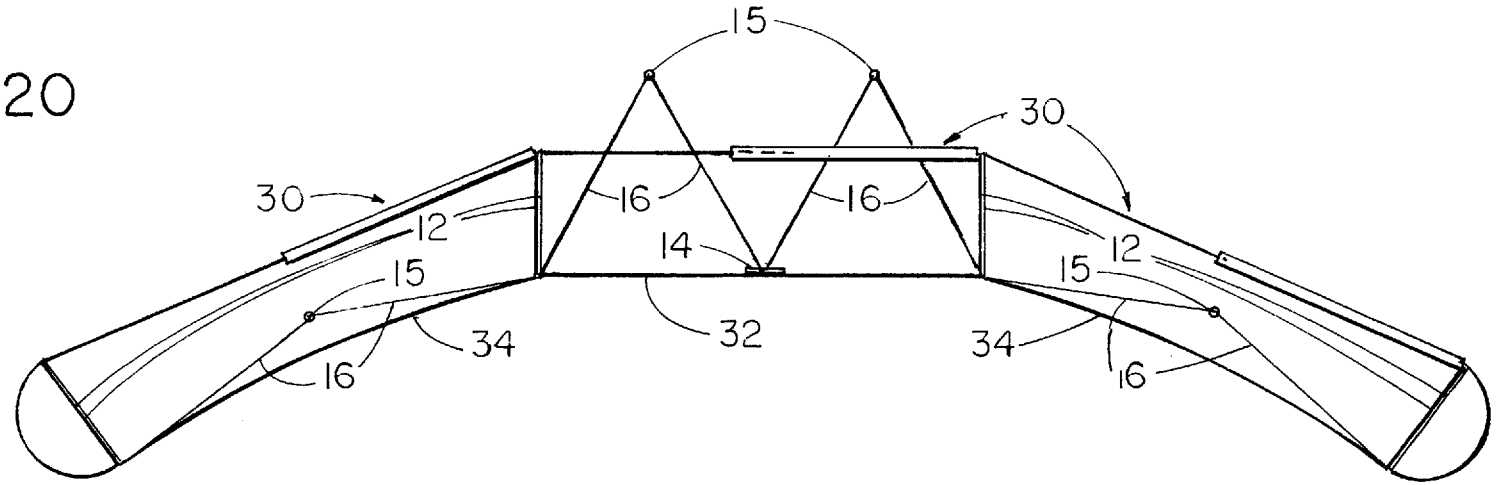
FIG. 20 is a top planar view of the display system of the present invention in an alternative configuration having both straight and concave shaping members.

As shown in FIGS. 9A through 11B, the adjustable stabilizing members 30 and the shaping members 32, 34 and 36 comprise of end clips 42 made of resilient plastic such as nylon or other strong plastic material. The end clips 42 are bifurcated at their ends in such a manner as to grip the cylindrical support members 12. Serrated inserts 46 connect and secure the end clips 42 to the stabilizing members 30, as shown in FIG. 9A, and to the shaping members 32, 34 and 36, as shown in FIG. 11A.

The display system 10 can be folded, simply by relative pivotal movement of the support members 12 and 16 such as to move the hub member 14 at the front of the frame away from the hub members 14 at the rear of the frame, into a compact bundle of the form shown roughly in FIG. 4. In this folded condition, the hub members 14 at the front of the bundle effectively combine to form a composite rectangular end plate and the hub members 14 at the rear of the bundle likewise effectively combine to form a corresponding rectangular end plate wherein the support members 12, 16 and springs 18 extend from one of these composite end plates to the other. In this collapsed position, the springs 18 are fully extended, but the force of the springs 18 is largely counteracted by compression in the struts 12 and 16 which are almost perpendicular to the composite end plates in this position. However, by lifting the bundle by the uppermost support members 12 and 16, the bundle is allowed to spread apart. The support members 12 and 16 are allowed to pivot with respect to each other and, therefore, allow the hub members 14 at the front and the rear of the bundle to spread apart upwardly and horizontally while the springs 18 draw the hub members 14 at the front towards those at the rear. The springs 18 are so selected that the force of the springs 18 as nearly as possible balances the opposing forces, due to the weight of the components as the display system 10 is unfolded, so that when the display system is fully unfolded it can remain in its erect and unfolded position without external support.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A collapsible display system having a front and a back, said display system comprising, in combination:

a plurality of adjacent box units with each having eight corners, said units defined by a plurality of hub members, said corners of said units having one of said plurality of hub members, and each of said plurality of adjacent units sharing common hub members;

a plurality of diagonal support members connected between said hub members on the front of the display system and respective opposite hub members on the back of the display system, said diagonal support members pivotly coupled to said hub members respectively, and each of said plurality of diagonal support members crossing over another of said plurality of diagonal support members in a scissors-like manner;

a plurality of horizontal support members with each having a pivot means at its midpoint for providing a flexible pivot point, each one of said plurality of horizontal support members disposed between two adjacent hub members of said plurality of hub members respectively and pivotly coupled thereto, each of said plurality of horizontal support members having a length greater than a distance between each of said hub members being connected thereto;

a plurality of shaping members horizontally disposed upon the display system, said shaping members detachably coupled to at least two of said diagonal support members whereby said plurality of shaping members help to form the display system;

a plurality of vertical support members vertically disposed within the display system, said plurality of vertical support members detachably coupled to at least two of said plurality of hub members whereby said plurality of vertical support members help to form the display system; and a plurality of adjustable stabilizing members, each of said plurality of stabilizing members comprising a telescoping means for adjusting the length of each of said adjustable stabilizing members, each of said adjustable stabilizing members being mounted within the display system such that said adjustable stabilizing members expand the display system as well as prevent the display system from distorting, each one of said stabilizing members being substantially horizontally disposed between two adjacent hub members of said plurality of hub members and detachably coupled to said diagonal support members being pivotly coupled to said hub members respectively.

2. The collapsible display system as claimed in claim 1 wherein said horizontal support members are disposed between said plurality of hub members upon the front of the display system.

3. The collapsible display system as claimed in claim 1 wherein said vertical support members are vertically disposed between said plurality of hub members upon the front of the display system.

4. The collapsible display system as claimed in claim 1 wherein said shaping members are horizontally disposed between said plurality of hub members upon the front of the display system.

5. The collapsible display system as claimed in claim 1 wherein said telescoping means comprises a telescoping brace comprised of inner and outer rod members, said rod members of each of said telescoping brace being slidable relative to each other to adjust the length of said telescoping brace, said rod members of each of said stabilizing members having a restricting means for restricting the maximum length of said telescoping brace.

6. The collapsible display system as claimed in claim 5 wherein said restricting means comprises a spring-biased pin on said inner rod member and a locking hole for engaging said spring-biased pin on said outer rod member.

7. The collapsible display system as claimed in claim 1 wherein said plurality of adjustable stabilizing members are disposed between said plurality of hub members on the back of the display system.

8. The collapsible display system as claimed in claim 1 wherein said plurality of vertical support members are manufactured of iron or steel whereby a cladding panel having a magnetic securing means thereon can readily be attached to the display system.

9. The collapsible display system as claimed in claim 1 further comprising a tensioning element, said tensioning element coupled between opposing hub members on the front and the back of the display system respectively.

10. The collapsible display system as claimed in claim 1 wherein said hub members comprise a central boss on one side, and four pairs of integral lugs extending from said central boss to respective edges of said hub member, each said pair of integral lugs being configured for allowing pivot coupling thereto.

11. A collapsible display system comprising, in combination, a plurality of support members coupled with a plurality of hub members, at least one of said plurality of support members being a vertical support member detachably connectable between at least one of said plurality of hub members and an adjoining hub member of said plurality of hub members wherein said plurality of hub members include a first plurality of hub members positioned in the front of the display system and a second plurality of hub members positioned in the back of the display system, said first and second plurality of hub members spaced from one another while the display system is in an erect position and pivotly connected with one another via another of said support members being diagonal support members, another of said support members being adjustable stabilizing members horizontally disposed between two adjacent hub members of said second plurality of hub members in the back of the display system and detachably coupled to said diagonal support members being pivotly coupled to said hub members respectively, said adjustable stabilizing members comprising a telescoping means for adjusting the length of said adjustable stabilizing member, and another of said support members being a horizontal support member having a pivot means at its midpoint for providing a flexible pivot point, each of said horizontal support members having a length greater than a distance between two adjacent hub members of said first plurality of hub members in the front of the display system.

12. The collapsible display system as claimed in claim 11 wherein another of said support members being a shaping member horizontally disposed upon the display system and detachably coupled to at least two of said diagonal support members upon the front of the display system.

13. The collapsible display system as claimed in claim 11 wherein said telescoping means comprises a telescoping brace comprised of inner and outer rod members, said rod members of each of said telescoping brace being slidable relative to each other to adjust the length of said telescoping brace, said rod members of each of said stabilizing members having a restricting means for restricting the maximum length of said telescoping brace.

14. The collapsible display system as claimed in claim 13 wherein said restricting means comprises a spring-biased pin on said inner rod member and a locking hole for engaging said spring-biased pin on said outer rod member.

15. The collapsible display system as claimed in claim 11 wherein said plurality of vertical support members are manufactured of iron or steel whereby a cladding panel having a magnetic securing means thereon can readily be attached to the display system.

16. The collapsible display system as claimed in claim further comprising a tensioning element, said tensioning element coupled between opposing hub members on the front and the back of the display system respectively.

17. The collapsible display system as claimed in claim 11 wherein said hub members comprise a central boss on one side, and four pairs of integral lugs extending from said central boss to respective edges of said hub member, each said pair of integral lugs being configured for allowing pivot coupling thereto.

* * * * *